United States Patent [19]

Ross et al.

[11] Patent Number: 4,498,536

[45] Date of Patent: Feb. 12, 1985

[54] METHOD OF WASHING, INJECTING SWABBING OR FLOW TESTING SUBTERRANEAN WELLS

[75] Inventors: Richard J. Ross; David J. Speller, both of Houston, Tex.

[73] Assignee: Baker Oil Tools, Inc., Orange, Calif.

[21] Appl. No.: 538,118

[22] Filed: Oct. 3, 1983

[51] Int. Cl.[3] ..... E21B 43/22

[52] U.S. Cl. ..... 166/250; 166/312; 166/307

[58] Field of Search ..... 166/127, 191, 307, 311, 166/312, 387, 250

[56] References Cited

U.S. PATENT DOCUMENTS

| | | | |
|---|---|---|---|
| 2,318,167 | 5/1943 | Knowlton | 166/312 |
| 3,861,465 | 1/1975 | Mignotte | 166/312 |
| 4,279,306 | 7/1981 | Weitz | 166/312 |

*Primary Examiner*—Stephen J. Novosad
*Assistant Examiner*—William P. Neuder
*Attorney, Agent, or Firm*—Norvell & Associates

[57] ABSTRACT

A method of chemical injection and of swabbing and/or flow testing a subterranean well by interconnecting a resettable packer and a circulating wash tool so that the packer may be positioned and set in the casing at a plurality of positions above the casing perforations. The introduction of pressurized chemical solution through the tubular work string produces an injection of the chemical solution into the perforations isolated by the vertically spaced annular sealing elements conventionally provided on the wash tool. Following the chemical treatment, the wash tool can be moved to a position above the perforations and a swab test run to measure the productive capabilities of the treated formation, all with a single trip of the wash tool and associated packer into the well.

3 Claims, 4 Drawing Figures

METHOD OF WASHING, INJECTING SWABBING OR FLOW TESTING SUBTERRANEAN WELLS

BACKGROUND OF THE INVENTION

1. Field of the Invention

The invention relates to a method for selectively effecting the washing of production zone fractures, the treatment of such fractures by injection with chemicals, such as acidic solutions, and, if required, the swabbing or flow testing of low flow wells after such treatment, utilizing a single tubular tool string which is run into the well only once to accomplish any one or all of the three operations.

2. Description of the Prior Art

After the casing of a subterranean well has been perforated in a production zone, it is often desirable to effect the washing or treatment of the adjacent perforations with water, acid, or chemicals or a series of washing or treating operations. If the well has very low flow characteristics, it may also be necessary to conduct a swabbing operation on the well to determine the rate of flow of oil from the treated perforations.

If the well has sufficient formation pressure, it may be necessary to isolate the producing zone and flow test the zone. While these individual operations have been known and practiced in the past, it has been necessary to make more than one round trip of appropriate tool strings into the well for accomplishing more than one of the aforementioned perforation treatment operations when using a packing element type washing or injecting tool to isolate short sections of the perforations.

SUMMARY OF THE INVENTION

This invention provides a method for permitting the selective washing, chemical injection or other treatment, and, if required, swab testing or flow testing of the production perforations of a subterranean well with a single trip of a tubular tool string into the well. Briefly, the invention contemplates the assembly of a tubular tool string including a resettable packer which is capable of being set and unset repeatedly in any selected downhole location. Below the packer, a wash tool is assembled having a pair of axially spaced, expandable elastomeric packing elements formed on its periphery which, through the application of fluid pressure to the bore of the tool, are capable of being expanded into sealing engagement with the casing bore. Washing fluid may then be injected into the formation adjacent any selected set of perforations positioned intermediate the annular packing elements. Following the washing operations, the same set of tools can be employed to effect the injection of chemical or other formation treatment solutions into the portion of the production zone. By setting of the packer, the casing annulus above the wash tool is sealed and a pressurized chemical treatment fluid, such as an acid, is injected into te production perforations. Any fluids, including noxious gases, such as $H_2S$, that flow out of the production zone into the casing perforations above or below the wash tool are not permitted to escape to the well surface through the well annulus.

Following the washing and/or treatment of a selected group of perforations, the packer is unset and moved vertically to position the wash tool in alignment with a second set of perforations, whereupon the washing and/or chemical treatment of another portion of the formation can be repeated.

In many wells, the natural pressure of production fluid is sufficiently low that it is necessary to provide a a special injection valving apparatus intermediate the packer and the perforation washing apparatus in order to equalize the hydrostatic pressure between the casing annulus and the bore of the wash tool when the washing or treatment operations are completed and the pressure of the washing or treating fluid is withdrawn. A pressure applicating valve of the type described in my copending application entitled "Valving Apparatus For Downhole Tools", Ser. No. 535,405, filed 9/26/83 (BST-52-PA-US), may be utilized to effect such equalization of the annulus pressure with that existing within the bore of the washing tool to permit the expandable annular elements of the washing tool to contract and permit the tool to be shifted to another location.

Additionally, in wells having low formation pressure, it is often necessary to conduct what is known in the art as swab tests. These tests contemplate the insertion through the tubing string of a rubber cup on a wire or sand line and such cup is successively raised and lowered to bring to the surface the fluid contained in the tubing. Naturally, the initial fluid thus retrieved will be either water from the wash or an acid or chemical solution from the treatment process. Eventually, however, the swabbing operation will bring to the surface a quantity of the oil flowing through the particular perforations isolated by the washing elements so that a measurement of the flow rate of the well can be made. Alternately, in wells having a high formation pressure it is often necessary to conduct what is known in the art as flow tests. These tests consist of isolating the zone to be tested from the casing annulus above the zone and reducing the hydrostatic pressure in the tubing string and on the zone so that the formation pressure will cause fluid or gas from the formation to flow up the tubing string to the surface. All of the aforedescribed operations can be accomplished with a single trip of the tubing string into the well, thus greatly minimizing the time and expense for completing the well.

Further advantages of the invention will be readily apparent to those skilled in the art from the following detailed description, taken in conjunction with the annexed sheets of drawings on which is illustrated a preferred embodiment of the invention.

DESCRIPTION OF THE PREFERRED EMBODIMENTS

Figure 1:
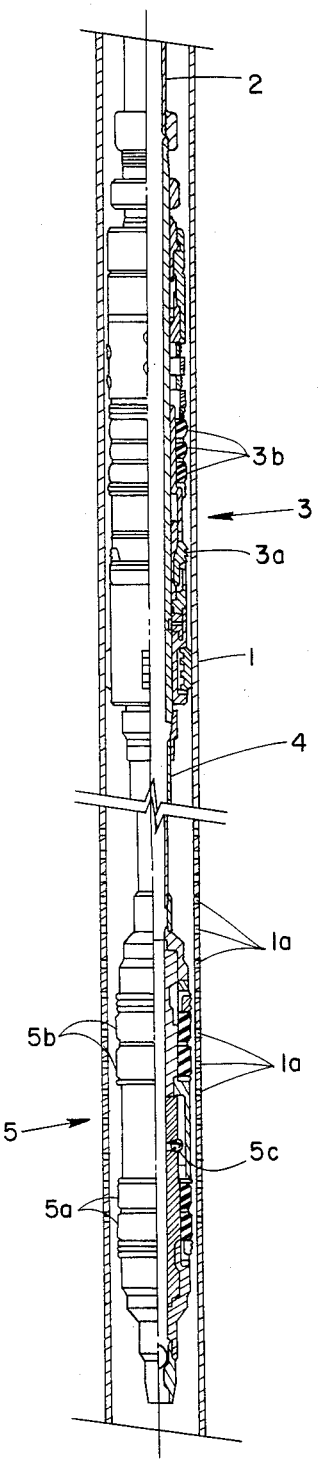
FIG. 1 is a schematic view of a tubular tool string for practicing the method of this invention, showing the assembly of a resettable packing element above a perforation washing element in their run-in positions.

Referring to FIG. 1, a well casing 1 is provided with perforations 1*a* in a production zone. The method of this invention is accomplished by first assembling on a tubular work string 2 a resettable packer 3 and a wash tool 5. Packer 3 may be a resettable packer which is capable of being set and unset in the well casing either by mechanical manipulation of the work string or through the application of fluid pressure down the work string. A suitable packer is that sold by BAKER SERVICE TOOLS of Houston, Tx., under the trademark RETRIEVAMATIC.

A length of spaceout tubing 4 is connected in depending relationship to packer 3 and on the bottom end of the spaceout tubing 4, a conventional circulating washing tool 5 is connected. The length of the spaceout tubing 4 is selected so that when the wash tool 5 is disposed adjacent the lowermost perforations 1*a* in the well casing 1, the resettable packer 3 will still be located above the perforations. As is customary, the resettable packer 3 is provided with casing engaging slips 3*a* and an expandable elastomer packing element 3*b*, which, when the packer is set, is expanded into sealing relationship with the bore of the casing 1. The wash tool 5 illustrated in the drawings is entirely conventional, and may, for example, comprise a Model C Packing Element Circulating Washer sold by BAKER SERVICE TOOLS of Houston, Tx. Accordingly, so detailed description of the construction of such tool will be made beyond pointing out the major components thereof.

Thus the wash tool 5 comprises two sets of vertically spaced, expandable elastomeric sealing elements 5*a* and 5*b*. Whenever the fluid pressure within the bore of the wash tool 5 exceeds that in the casing annulus, a piston and cylinder arrangement (not shown) effects the compression of the annular sealing elements 5*a* and 5*b* to expand the same into sealing engagement with the bore of the casing 1, thus isolating a set of perforations 1*a* which are disposed intermediate the annular sealing elements 5*a* and 5*b*. Pressured fluid flows from the bore of the wash tool to its periphery through a pressure relief valve 5*c*.

Figure 2:
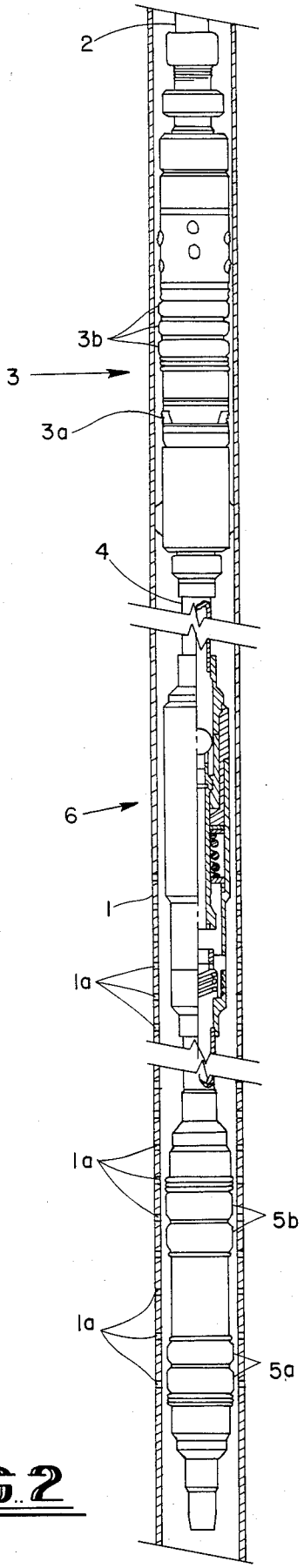
FIG. 2 is a view similar to FIG. 1 but illustrating a modified form of apparatus wherein a pressure equalizing valve is inserted in the tool string between the packing element and the washing element in order to permit the equalization of pressure between the annulus and the bore of the tool when it is desired to disengage the packing elements on the washing from the casing.

In the event that the particular well has a relatively low fluid level, it is then desirable to incorporate a third tool in series relationship intermediate the packer 3 and the wash tool 5. Such third tool is shown in FIG. 2 as the control valve 6 which is fully described and illustrated in my above mentioned co-pending application. The purpose of the control tool 6 is to insure that an increase in fluid pressure supplied through the work string 2 is transmitted to the wash tool 5 to effect its operation. At the same time, when that fluid pressure is removed, the control tool 6 operates to equalize the tubing pressure with the casing annulus pressure in the vicinity of the wash tool 5, and thus permits the sealing elements 5*a* and 5*b* of the wash tool 5 to contract and disengage from the bore of casing 1. It is only necessary to incorporate the control tool 6 in wells having a sufficiently low flow rate that the hydrostatic pressure in the casing annulus is not equal to the hydrostatic pressure of the column of fluid contained within the work string and the interconnected packer 3, control tool 6 and wash tool 5.

Figure 3:
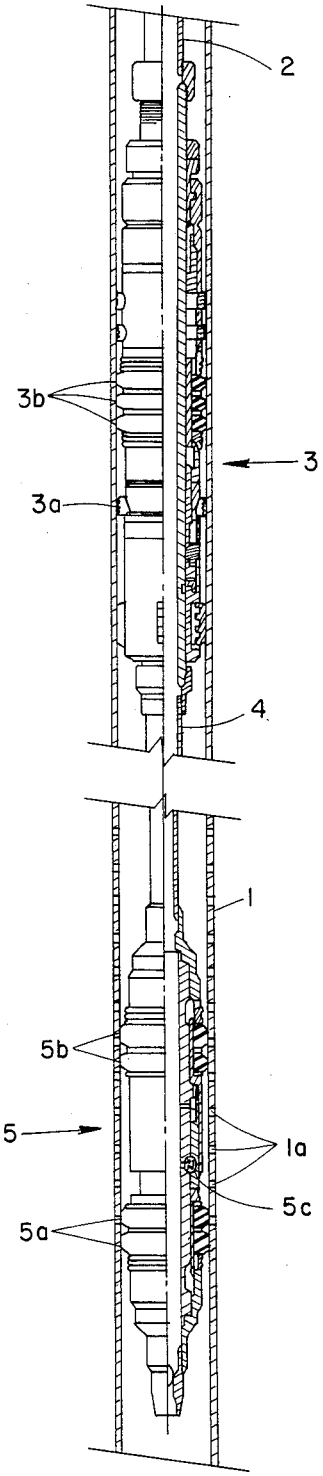
FIG. 3 is a view similar to FIG. 1 but illustrating the position of the packer and the washing element for accomplishing the acid or other chemical treatment of the fractures in the production zone adjacent the perforations isolated by the washing element.

Referring now to FIG. 3, the desirable operation of the assemblage of FIG. 1 as a chemical treatment tool can be appreciated. The packer 3 is first set at a position above all of the perforations 1*a* of the particular production zone and the length of the spaceout tubing 4 is selected so as to position the wash tool adjacent the lowermost perforations 1*a* of the particular production zone. A suitable chemical treatment fluid is then introduced through the tubular work string 2 under sufficient fluid pressure so as to cause the operation of the wash tool 5. In other words, the expandable annular packing elements 5*a* and 5*b* are expanded into sealing engagement with the bore of casing 1 and the pressurized chemical treatment fluid, which is generally an acid, is injected through the isolated perforations 1*a* into the adjacent fractures in the production zone. Some of the injected fluid can, of course, return to the casing annulus through perforations 1*a* located above the uppermost packing elements 5*b* of the washer, but cannot proceed up the casing annulus to the well surface due to the fact that the packer 3 has been set. Thus, objectionable gases, such as $H_2S$, are effectively prevented from passing to the surface through the casing annulus. The larger portion of the injected flud is forced into the formation.

After the lowermost group of perforations 1*a* are acid treated, the tubing fluid pressure is reduced so as to retract the annular sealing elements 5*a* and 5*b* of the wash tool 5. Subsequently, the resettable packer 3 is operated to disengage from the bore of casing 1, permitting the entire assembly to be moved upwardly so that the wash tool 5 is positioned adjacent the next higher group of perforations 1*a*. In this position, the packer 3 is again set, pressurized chemical treatment fluid is introduced through the tubular work string 2 to expand the annular sealing elements 5*a* and 5*b* of the wash tool 5 into engagement with the casing bore and chemical treatment of the adjacent fractures of the production zone proceeds in the same manner as previously described. Thus, in this manner all of the fractures of the production zone may be treated.

Figure 4:
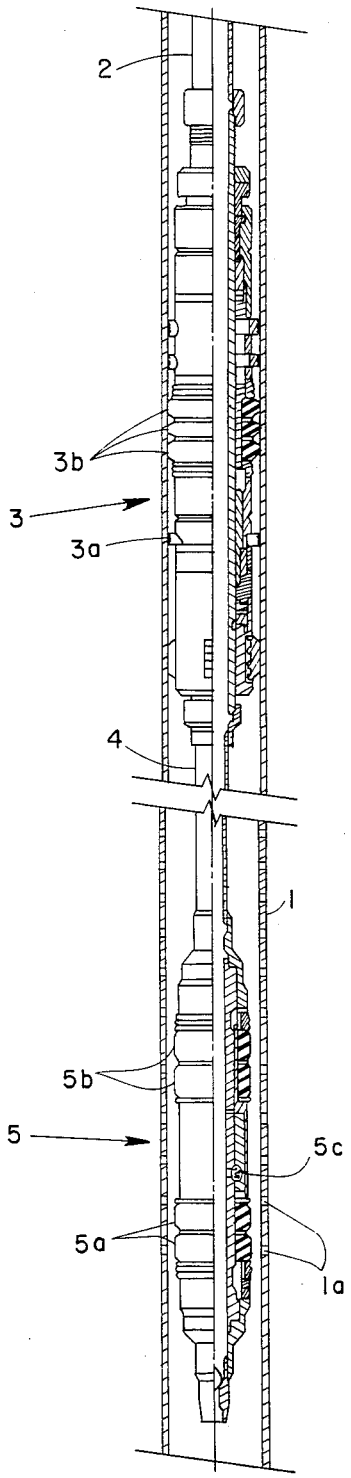
FIG. 4 is a view similar to FIG. 1 but illustrating the position of the packer and the washing element during the accomplishment of a swab test on wells having low flow rates.

Referring now to FIG. 4, after the chemical treatment of the perforations of the production zone has been completed, the packer 3 and the assembled washing tool 5 are elevated to a position above all of the casing perforations 1*a*, and the packer alone is then reset. A swab test may then be conducted by inserting a swabbing tool on a wire line through the bore of the tubular work string 2. The swab is of entirely conventional configuration and has therefore not been illustrated. It is lowered through the bore of the work string 2, to a point several hundred feet below the fluid level in the tubing. It is then raised to a point just below the top of the well, and this produces an overflow at the surface of fluid contained in the work string 2. The swabbing tool is then lowered and the operation repeated until all of the acid solution has been moved and, whereupon the produced fluids will be brought to the surface by operation of the swab tool and the volume of such produced fluids will indicate the flow rate of the well.

Those skilled in the art will recognize that the aforedescribed apparatus could also be utilized to accomplish conventional perforation washing operations simply by not setting packer 3, but producing an expansion of the packing element 5*a* and 5*b* of the washer 5 by pressurized washing fluid in work string 2 and then forcing the washing fluid through the isolated perforations 1*a* and back into the casing annulus through the remaining perforations 1*a* from whence it returns to the well surface through the open passage provided by the casing annulus.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. The method of chemical treatment and testing of the formation in a production zone adjacent to the well casing perforations by a single trip of a tubing string into the well comprising the steps of:

1. Assembling a circulating washer tool in series relation to a tubing carried resettable packer, said washer having a pair of vertically spaced packing elements expandable by tubing applied fluid pressure into sealing engagement with the casing bore to isolate an axially extending group of perforations;
2. Inserting the assembled washer, packer and tubing string into the well until the expandable packing elements on the washer straddle a selected group of casing perforations and the packer is positioned above all of the casing perforations;
3. Setting the packer to isolate the casing annulus below the packer from the surface;
4. Applying pressurized chemical treatment fluid down the tubing string to expand the expandable packing elements on the washer into sealing engagement with the casing bore and injecting said pressurized chemical treatment fluid into the formation adjacent the isolated casing perforations;
5. Reducing the tubing pressure;
6. Unsetting the packer and moving the washer adjacent a second set of casing perforations;
7. Repeating steps 3 and 4 to successively treat substantially all portions of the formation adjacent the perforations;
8. Reducing the tubing string fluid pressure to retract the washer packing elements;
9. Unsetting the packer and moving the entire assembly above the perforations and resetting the packer; and
10. Performing a test to indicate the production flow into the washer.

2. The method of claim 1 wherein the test performed comprises swab testing the production flow into the tubing through the washer.

3. The method of claim 1 wherein the test performed comprises flow testing the production into the tubing string through the washer.

* * * * *